US010544714B2

(12) United States Patent
Smith

(10) Patent No.: US 10,544,714 B2
(45) Date of Patent: Jan. 28, 2020

(54) VARIABLE CAMSHAFT TIMING DEVICE WITH TWO LOCKING POSITIONS

(71) Applicant: BorgWarner Inc., Auburn Hills, MI (US)

(72) Inventor: Franklin R. Smith, York, SC (US)

(73) Assignee: BorgWarner Inc., Auburn Hills, MI (US)

( * ) Notice: Subject to any disclaimer, the term of this patent is extended or adjusted under 35 U.S.C. 154(b) by 30 days.

(21) Appl. No.: 16/024,943

(22) Filed: Jul. 2, 2018

(65) Prior Publication Data

US 2019/0003348 A1 Jan. 3, 2019

Related U.S. Application Data

(60) Provisional application No. 62/527,629, filed on Jun. 30, 2017.

(51) Int. Cl.
*F01L 1/344* (2006.01)
*F01L 1/047* (2006.01)
(Continued)

(52) U.S. Cl.
CPC ..... *F01L 1/3442* (2013.01); *F15B 11/10* (2013.01); *F15B 13/0402* (2013.01);
(Continued)

(58) Field of Classification Search
CPC ..... F01L 1/3442; F01L 1/344; F01L 1/34409; F01L 1/047; F01L 2001/3443;
(Continued)

(56) References Cited

U.S. PATENT DOCUMENTS 4,627,825 A 12/1986 Bruss et al.
4,858,572 A 8/1989 Shirai et al.
(Continued)

FOREIGN PATENT DOCUMENTS

CN 1495344 A 5/2004
CN 1755066 A 4/2006
(Continued)

OTHER PUBLICATIONS

International Search Report for PCT/US2009/036611 dated Aug. 20, 2009; 10 pgs.
(Continued)

*Primary Examiner* — Laert Dounis
*Assistant Examiner* — Kelsey L Stanek
(74) *Attorney, Agent, or Firm* — Brown & Michaels, PC

(57) ABSTRACT

A system including a phaser with a first lock pin and a second lock pin in the rotor assembly. The first and second locks pins having a locked position where they engage a recess in the housing assembly and an unlocked position in which they do not engage the housing assembly. The first lock pin locks the rotor assembly to the housing assembly when the phaser is in or near an intermediate phase angle position. The second lock pin locks the rotor assembly to the housing assembly when the phaser is at a full retard position. Alternatively, the second lock pin can lock the rotor assembly to the housing assembly when the phaser is at a full advance position. The second lock pin is spring biased towards the unlocked position and is pressurized to engage and move to the locked position by either the advance or the retard chamber.

16 Claims, 7 Drawing Sheets

(51) Int. Cl.

| | |
|---|---|
| ***F15B 11/10*** | (2006.01) |
| ***F15B 13/04*** | (2006.01) |
| ***F15B 15/12*** | (2006.01) |
| ***F15B 15/26*** | (2006.01) |

(52) U.S. Cl.
CPC ..... *F15B 15/12* (2013.01); *F15B 15/261* (2013.01); *F01L 2001/3443* (2013.01); *F01L 2001/34459* (2013.01); *F01L 2001/34466* (2013.01); *F15B 2211/30525* (2013.01); *F15B 2211/7058* (2013.01); *F15B 2211/7653* (2013.01)

(58) Field of Classification Search
CPC ... F01L 2001/34459; F01L 2001/34466; F01L 2001/34433; F15B 11/10; F15B 13/0402; F15B 15/12; F15B 15/261; F15B 2211/30525; F15B 2211/7058; F15B 2211/7653
USPC ..... 123/90.17
See application file for complete search history.

(56) References Cited

U.S. PATENT DOCUMENTS

| | | | | |
|---|---|---|---|---|
| 5,002,023 | A | 3/1991 | Butterfield et al. | |
| 5,107,804 | A | 4/1992 | Becker et al. | |
| 5,497,738 | A | 3/1996 | Siemon et al. | |
| 5,657,725 | A | 8/1997 | Butterfield et al. | |
| 5,738,056 | A | 4/1998 | Mikame et al. | |
| 5,797,361 | A | 8/1998 | Mikame et al. | |
| 5,924,395 | A | 7/1999 | Moriya et al. | |
| 6,170,448 | B1 | 1/2001 | Asakura | |
| 6,302,072 | B1 | 10/2001 | Sekiya et al. | |
| 6,311,655 | B1 | 11/2001 | Simpson et al. | |
| 6,374,787 | B2 | 4/2002 | Simpson et al. | |
| 6,453,856 | B1 | 9/2002 | Smith et al. | |
| 6,481,402 | B1 | 11/2002 | Simpson et al. | |
| 6,526,930 | B2 | 3/2003 | Takahashi et al. | |
| 6,666,181 | B2 | 12/2003 | Smith et al. | |
| 6,684,835 | B2 | 2/2004 | Komazawa et al. | |
| 6,745,735 | B2 | 6/2004 | Smith | |
| 6,763,791 | B2 | 7/2004 | Gardner et al. | |
| 6,779,499 | B2 | 8/2004 | Takenaka et al. | |
| 6,814,038 | B2 | 11/2004 | Smith | |
| 6,941,913 | B2 | 9/2005 | Smith | |
| 7,000,580 | B1 | 2/2006 | Smith et al. | |
| 7,137,371 | B2 | 11/2006 | Simpson et al. | |
| 7,194,992 | B2 | 3/2007 | Smith | |
| 7,240,651 | B1 | 7/2007 | Hanshaw | |
| 7,270,096 | B2 | 9/2007 | Lancefield et al. | |
| 7,444,968 | B2 | 11/2008 | Lancefield et al. | |
| 7,527,028 | B2 | 5/2009 | Leone | |
| 7,669,566 | B2 | 3/2010 | Methley | |
| 7,765,955 | B2 | 8/2010 | Brooks et al. | |
| 7,765,966 | B2 | 8/2010 | Leone | |
| 7,934,479 | B2 | 5/2011 | Strauss | |
| 8,006,660 | B2 | 8/2011 | Strauss et al. | |
| 8,011,337 | B2 | 9/2011 | Hayashi | |
| 8,028,667 | B2 | 10/2011 | Hayashi | |
| 8,047,170 | B2 | 11/2011 | Strauss et al. | |
| 8,069,829 | B2 | 12/2011 | Leone | |
| 8,356,583 | B2 | 1/2013 | Smith | |
| 8,893,677 | B2 | 11/2014 | Smith | |
| 10,344,632 | B2 * | 7/2019 | Smith | F01L 1/3442 |
| 2002/0043230 | A1 | 4/2002 | Kinugawa | |
| 2005/0103297 | A1 | 5/2005 | Simpson | |
| 2005/0229880 | A1 | 10/2005 | Hashizume | |
| 2010/0139593 | A1 | 6/2010 | Takemura | |
| 2010/0251981 | A1 | 10/2010 | McCloy et al. | |
| 2011/0017156 | A1 | 1/2011 | Smith | |
| 2012/0145098 | A1 | 6/2012 | Crowe et al. | |
| 2013/0008399 | A1 | 1/2013 | Busse et al. | |
| 2016/0130988 | A1 * | 5/2016 | Smith | F01L 1/3442<br>123/90.17 |

FOREIGN PATENT DOCUMENTS

| | | | |
|---|---|---|---|
| CN | 101046165 | A | 10/2007 |
| CN | 101952560 | A | 1/2011 |
| GB | 2278661 | A | 12/1994 |
| GB | 2437305 | | 10/2007 |
| GB | 2432645 | B | 12/2010 |
| JP | 02149707 | A | 6/1990 |
| JP | 09280017 | A | 10/1997 |
| JP | 11-210424 | | 8/1999 |
| JP | 2000230511 | A | 8/2000 |
| JP | 2000320356 | A | 11/2000 |
| JP | 2001-098910 | | 4/2001 |
| JP | 2002309975 | A | 10/2002 |
| JP | 2007138744 | A | 6/2007 |
| WO | 2009114500 | A1 | 9/2009 |
| WO | 2012047748 | A2 | 4/2012 |

OTHER PUBLICATIONS

Staub, A. et al.; Quo vadis hydraulic variable camshaft phasing unit?; 2010; pp. 215-225.
International Search Report for PCT/US2011/054196 dated May 7, 2012; 9 pgs.
Miura, T. et al.; Development of a Hydraulic Variable Valve Timing Control System with an Optimum Angular Position Locking Mechanism; SAE International; 2012; 14 pages.
International PCT Search Report for PCT/US2014/023838 dated Aug. 26, 2014; 12 pgs.

* cited by examiner

VARIABLE CAMSHAFT TIMING DEVICE WITH TWO LOCKING POSITIONS

CROSS-REFERENCE TO RELATED APPLICATIONS

This application claims the benefit of U.S. patent application Ser. No. 62/527,629 filed on Jun. 30, 2017, the disclosure of which is herein incorporated by reference in its entirety.

BACKGROUND

Field of the Invention

The invention pertains to the field of variable camshaft timing mechanisms. More particularly, the invention pertains to a variable camshaft timing device with two lock positions.

Description of Related Art

Internal combustion engines have employed various mechanisms to vary the relative timing between the camshaft and the crankshaft for improved engine performance or reduced emissions. The majority of these variable camshaft timing (VCT) mechanisms use one or more "vane phasers" on the engine camshaft (or camshafts, in a multiple-camshaft engine). As shown in the figures, vane phasers have a rotor assembly 105 with one or more vanes 104, mounted to the end of the camshaft, surrounded by a housing assembly 100 with the vane chambers into which the vanes fit. It is possible to have the vanes 104 mounted to the housing assembly 100, and the chambers in the rotor assembly 105, as well. The housing's outer circumference 101 forms the sprocket, pulley or gear accepting drive force through a chain, belt, or gears, usually from the crankshaft, or possible from another camshaft in a multiple-cam engine.

Apart from the camshaft torque actuated (CTA) variable camshaft timing (VCT) systems, the majority of hydraulic VCT systems operate under two principles, oil pressure actuation (OPA) or torsional assist (TA). In the oil pressure actuated VCT systems, an oil control valve (OCV) directs engine oil pressure to one working chamber in the VCT phaser while simultaneously venting the opposing working chamber defined by the housing assembly, the rotor assembly, and the vane. This creates a pressure differential across one or more of the vanes to hydraulically push the VCT phaser in one direction or the other. Neutralizing or moving the valve to a null position puts equal pressure on opposite sides of the vane and holds the phaser in any intermediate position. If the phaser is moving in a direction such that valves will open or close sooner, the phaser is said to be advancing and if the phaser is moving in a direction such that valves will open or close later, the phaser is said to be retarding.

The torsional assist (TA) systems operates under a similar principle with the exception that it has one or more check valves to prevent the VCT phaser from moving in a direction opposite than being commanded, should it incur an opposing force such as torque.

The problem with OPA or TA systems is that the oil control valve defaults to a position that exhausts all the oil from either the advance or retard working chambers and fills the opposing chamber. In this mode, the phaser defaults to moving in one direction to an extreme stop where the lock pin engages. The OPA or TA systems are unable to direct the VCT phaser to any other position during the engine start cycle when the engine is not developing any oil pressure. This limits the phaser to being able to move in one direction only in the engine shut down mode. In the past this was acceptable because at engine shut down and during engine start the VCT phaser would be commanded to lock at one of the extreme travel limits (either full advance or full retard).

Furthermore, by reducing the idling time of an internal combustion engine in a vehicle, the fuel efficiency is increased and emissions are reduced. Therefore, vehicles can use a "stop-start mode" which automatically stops and automatically restarts the internal combustion engine to reduce the amount of time the engine spends idling when the vehicle is stopped, for example at a stop light or in traffic. This stopping of the engine is different than a "key-off" position or manual stop via deactivation of the ignition switch in which the user of the vehicle shuts the engine down or puts the car in park and shuts the vehicle off. In "stop-start mode", the engine stops as the vehicle is stopped, then automatically restarts in a manner that is nearly undetectable to the user of the vehicle. In the past, vehicles have been designed primarily with cold starts in mind, since that is the most common situation. In a stop-start system, because the engine had been running until the automatic shutdown, the automatic restart occurs when the engine is in a hot state. It has long been known that "hot starts" are sometimes a problem because the engine settings necessary for the usual cold start—for example, a particular valve timing position—are inappropriate to a warm engine.

SUMMARY OF THE INVENTION

A phaser has a first lock pin and a second lock pin in the rotor assembly. The first and second locks pins having a locked position where they engage a recess in the housing assembly and an unlocked position in which they do not engage the housing assembly. The first lock pin locks the rotor assembly to the housing assembly when the phaser is in or near an intermediate phase angle position. The second lock pin locks the rotor assembly to the housing assembly when the phaser is at a full retard position. Alternatively, the second lock pin can lock the rotor assembly to the housing assembly when the phaser is at a full advance position.

In an embodiment of the present invention, the phaser has two distinct and separate locking positions which are easy to control and can be commanded to engage. A first lock pin is controlled by a control valve of the variable cam timing mechanism or phaser and the second lock pin is pressurized to engage and is controlled by pressure in a working chamber of the phaser, either the advance chamber or the retard chamber. Therefore, the phaser can be locked at a mid or intermediate position and an end position, either when the vane is at the advance end stop or the retard end stop.

In another embodiment, the first and second lock pins are pressure to release and engage at opposite stops, e.g. full advance stop and full retard stop, with at least one of the locks pins being controlled by a working chamber.

In another embodiment, the first and second lock pins are pressure to release and engage at opposite stops, e.g. full advance stop and full retard stop, with the first and second locks pins each being controlled by a separate working chamber.

DETAILED DESCRIPTION OF THE INVENTION

Figure 1:
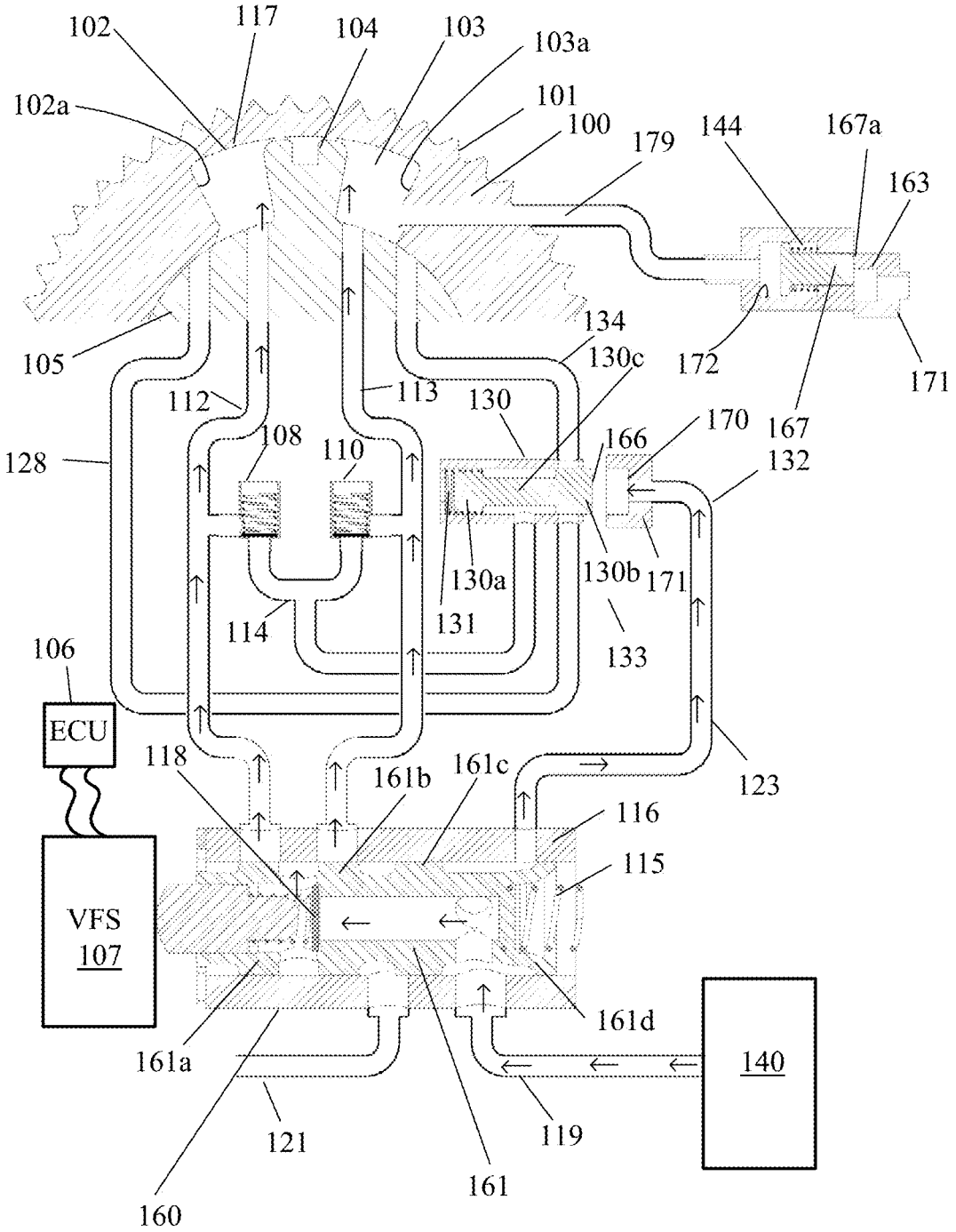
FIG. 1 shows a schematic of a torsion assist phaser in the null position.

Some of the embodiments of the present invention include a phaser which has an offset or remote piloted valve added to the hydraulic circuit to manage a hydraulic detent switching function, in order to provide a mid-position lock for cold starts of the engine, either during cranking or prior to complete engine shutdown is used. The mid-position locking of the phaser positions the cam at an optimum position for cold restarts of the engine once a current signal has been removed from the actuator, or variable force solenoid. The present invention also discloses locking the phaser in a full retard position during an automatic "stop" of the engine in stop-start mode.

The phasers of the present invention have two distinct, and separate locking positions which are easy to control and can be commanded to engage. In one embodiment, a first lock pin is controlled by control valve of the variable cam timing mechanism or phaser and the second lock pin is pressurized to engage and is controlled by pressure in a working chamber of the phaser, either the advance chamber or the retard chamber. Therefore, the phaser can be locked at a mid or intermediate position and an end position, either when the vane is at the advance end stop or the retard end stop. The first lock pin may be part of the detent valve of the phaser.

In a locked position, the first or second lock pins may be axially oriented lock pins and engage an outer end plate of the housing assembly of the phaser. Alternatively, the first or second lock pins may be radially oriented lock pins and engage the rotor assembly of the phaser when in a locked position.

In an alternate embodiment, the phaser has two distinct and separate locking positions which are easy to control and can be commanded to engage. The first lock pin is controlled by pressure of a first working chamber, for example the advance working chamber and the second locking pin is controlled by the pressure of the second working chamber, for example the retard working chamber.

In one embodiment, one of the lock pins is moved to a locked position when the phaser is in a full retard position and the other of the lock pins is moved to a locked position when the phaser is in a mid position or intermediate phase angle. In an alternative embodiment, one of the lock pins is moved to a locked position when the phaser is in a full advance position and the other of the lock pins is moved to a locked position when the phaser is in a mid position or intermediate phase angle. In yet another alternative embodiment, one of the lock pins is moved to a locked position when the phaser is in a full advance position and the other of the lock pins is moved to a locked position when the phaser is in a full retard position.

The piloted valve may be controlled on/off with the same hydraulic circuit that engages or releases one of the two lock pins. This shortens the variable cam timing (VCT) control valve to two hydraulic circuits, a VCT control circuit and a combined lock pin/hydraulic detent control circuit. Movement of the piloted valve to the first position is actively controlled by the remote on/off valve or the control valve of the phaser.

The other of the two lock pins is controlled by the advance or retard working chambers of the phaser.

One of the advantages to using the remote piloted valve is that it can have a longer stroke than the control valve, since it is not limited by a solenoid. Therefore, the piloted valve can open up a larger flow passage for the hydraulic detent mode and improve actuation rate in the detent mode. In addition, the location of the remote piloted valve shortens and simplifies the hydraulic detent circuit and thereby increases performance of the VCT detent mode or intermediate phase angle position of the phaser.

FIGS. 1-7 show the operating modes of a TA VCT phaser depending on the spool valve position. The positions shown in the figures define the direction the VCT phaser is moving to. It is understood that the phase control valve has an infinite number of intermediate positions, so that the control valve not only controls the direction the VCT phaser moves but, depending on the discrete spool position, controls the rate at which the VCT phaser changes positions. Therefore, it is understood that the phase control valve can also operate in infinite intermediate positions and is not limited to the positions shown in the Figures.

Referring to FIG. 1-5, in this embodiment, the TA or OPA VCT phasers can have one or more working chambers which operate in a cam torque actuated (CTA) operating mode. The invention utilizes the control valve in a detent mode and a hydraulic detent circuit to direct the VCT phaser in either direction, advance or retard, to reach the mid lock position and, if so desired, to engage a lock pin at that mid lock position. The following description and embodiments are described in terms of a torsion assisted (TA) phaser, which has one or more check valves in oil supply lines, but it will be understood that they are also applicable to an oil pressure actuated phaser. An offset or remote piloted valve is added to a hydraulic circuit of a torsion assist or oil pressure actuated phaser to manage the hydraulic detent switching function. One end of the remote piloted valve serves as the first lock pin and in a locked position, locks the housing assembly relative to the rotor assembly at mid-position.

The housing assembly 100 of the phaser has an outer circumference 101 for accepting drive force. The rotor assembly 105 is connected to the camshaft and is coaxially located within the housing assembly 100. The rotor assembly 105 has a vane 104 separating a chamber 117 formed between the housing assembly 100 and the rotor assembly 105 into an advance chamber 102 and a retard chamber 103. The vane 104 is capable of rotation to shift the relative angular position of the housing assembly 100 and the rotor assembly 105. Additionally, a hydraulic detent circuit 133 and a lock pin circuit 123 are also present. The hydraulic detent circuit 133 and the lock pin circuit 123 are essentially one circuit as discussed above, but will be discussed separately for simplicity.

The hydraulic detent circuit 133 includes a spring 131 loaded piloted valve 130 and an advance detent line 128 that connects the advance chamber 102 to the piloted valve 130 and the common line 114 to check valves 108, 110, and a retard detent line 134 that connects the retard chamber 103 to the piloted valve 130 and the common line 114 to check valves 108, 110. The advance detent line 128 and the retard detent line 134 are a predetermined distance or length from the vane 104. The piloted valve 130 is in the rotor assembly 105 and is fluidly connected to the lock pin circuit 123 and line 119 through line 132. The lock pin circuit 123 includes the piloted valve 130, supply line 119, and exhaust at the end of the spool, and line 132. The piloted valve 130 has a first land 130*a* and a second land 130*b* separated by a spindle 130*c*. The second land 130*b* acts as the first lock pin 166. An end portion of the land 130*b* of the piloted valve is biased by spring 131 towards and fits into a recess 170 in the outer end plate 171 of the housing assembly 100. It should be noted that the recess can also be present on the inner end plate of the housing assembly 100.

The second lock pin 167 is slidably housed in a bore 172 in the rotor assembly 105. An end portion 167*a* of the second lock pin 167 fits into a recess 163 in the outer end plate 171 of the housing assembly 100. The second lock pin 167 is pressurized by the retard chamber 103 to move towards the locked position through the retard lock port 179, engaging the recess 163. The retard lock port 179 is a predetermined distance or length from the vane 104 and is present in the rotor assembly 105. The retard lock port 179, while drawn schematically in the drawings, is positioned such that the port only receives fluid or is in fluid communication with the retard chamber 103 when the phaser is in the full retard position as discussed further below. The retard lock port 179 is not in fluid communication with the retard chamber 103 when the phaser is moving towards or in the advance position. The second lock pin 167 is spring 144 biased to move to the unlocked position, where the lock pin 167 does not engage the recess 163 of the housing assembly 100 and the retard lock port 179 is vented.

The opening and closing of the hydraulic detent circuit 133 and pressurization of the lock pin circuit 123 are both controlled by the switching/movement of the phase control valve 160.

A phase control valve 160, preferably a spool valve, includes a spool 161 with cylindrical lands 161*a*, 161*b*, 161*c*, and 161*d* slidably received in a sleeve 116. The control valve may be located remotely from the phaser, within a bore in the rotor assembly 105 which pilots in the camshaft, or in a center bolt of the phaser. One end of the spool 161 contacts spring 115 and the opposite end of the spool 161 contacts a pulse width modulated variable force solenoid (VFS) 107. The solenoid 107 may also be linearly controlled by varying current or voltage or other methods as applicable. Additionally, the opposite end of the spool 161 may contact and be influenced by a motor, or other actuators. Hydraulic lines 112, 113 connect the control valve 160 to the advance chamber 102 and the retard chamber 103.

The position of the spool 161 is influenced by spring 115 and the solenoid 107 controlled by the EEC or ECU 106. Further detail regarding control of the phaser is discussed in detail below. The position of the spool 161 controls the motion (e.g. to move towards the advance position, holding position, the retard position, or the retard lock position) of the phaser as well as whether the lock pin circuit 123 and the hydraulic detent circuit 133 are open (on) or closed (off). In other words, the position of the spool 161 actively controls the piloted valve. The control valve 160 has an advance mode, a retard mode, a retard locking mode, a null mode (holding position), and a detent mode.

In the advance mode, the spool 161 is moved to a position so that fluid may flow from supply S by pump 140, through line 119, through the inlet check valve 118 to the advance chamber 102 and fluid from the retard chamber 103 exits through the spool 161 to exhaust line 121. The detent valve circuit 133 is off or closed and the first lock pin 166 is moved to the unlock position by oil pressure from supply line 119 via line 132 and the second lock pin 167 is vented through the retard lock pin port 179 to an unlocked position in which neither lock pin 167, 166 engages a recess 163, 170 of the housing assembly 100.

In the retard mode, the spool 161 is moved to a position so that fluid may flow from supply S by pump 140 through line 119 and inlet check valve 118, to the retard chamber 103 and fluid from the advance chamber 102 exits through the spool 161 to the engine between the first spool land 161*a* and the sleeve 116. The detent valve circuit 133 is off and the first lock pin 166 is biased by pressure from supply line 119 via line 132 and the second lock pin 167 is biased by spring 144 to an unlocked position in which neither the first or second lock pins 167, 166 engage a recess 163, 170 of the housing assembly 100.

In holding position or null mode, the spool 161 is moved to a position that is partially open to the advance chamber 102 and the retard chamber 103 and allows supply fluid to bleed into the advance and retard chambers 102, 103, applying the same pressure to the advance chamber and retard chamber to hold the vane 104 position. The detent valve circuit 133 is off and the first lock pin 166 is biased by supply pressure from supply line 119 via line 132 to an unlocked position and the second lock pin 167 is biased by spring 144 to an unlocked position in which neither the first or second lock pins 167, 166 engage a recess 163, 170 of the housing assembly 100.

In the retard locking mode, the vane 104 has already been moved to a full retard position and fluid continues to flow from supply S by pump 140 through inlet check valve 118 and through line 119, to the retard chamber 103 and fluid from the advance chamber 102 exits through the spool 161 to the engine block between the first spool land 161*a* and the sleeve 116. Fluid from the retard chamber 103 provides pressure to the second lock pin 167 through the retard locking port 179 to engage recess 163, as the retard locking port 179 in this position is in fluid communication with the retard chamber 103. The second lock pin 167 is pressurized to engage only when the vane 104 of the rotor assembly 105 is at or near the retard stop. The retard locking port 179 can be radial or axial and is metered by the housing assembly 100 or a feature in the end plate 171. Any duty cycle of the VFS 107 above the null position pressurizes the retard chamber 103. The "full retard position" is defined as the vane 104 contacting the advance wall 102*a* of the chamber 117. The first lock pin 166 is moved to the unlock position by oil pressure from supply line 119 via line 132 to an unlocked position.

In the detent mode, three functions occur simultaneously. The first function in the detent mode is that the spool 161 moves to a position in which spool land 161*c* blocks exhaust line 121, spool land 161*d* blocks fluid from flowing to line 132 of the piloted valve 130, and spool lands 161*a* and 161*b* blocks fluid from exhausting from the exhaust line 112. Fluid from line 119 can enter the advance chamber 102, through the inlet check valve 118 and line 112. Fluid will also fill the retard chamber 103 through the detent valve circuit 133 due to a slight underlap of the ports of the piloted valve 130 and the rotor assembly 105. By blocking the exhaust lines by the spool 161 to keep the advance and retard chambers 102, 103 full, effectively removes control of the phaser from the control valve 160.

The second function in detent mode is to open or turn on the detent valve circuit 133. With the detent valve is open, one or more of the torsion assist advance and retard chambers 102, 103 are converted to cam torque actuated (CTA) mode. In other words, fluid is allowed to recirculate between the advance chamber and the retard chamber, instead of supply 140 filling one chamber 102, 103 and exhausting the opposite chamber to sump through exhaust lines 121. The detent valve circuit 133 has complete control over the phaser moving to advance or retard, until the vane 104 reaches the intermediate phase angle position. The piloted valve 130 is moved to this position through the blocking of fluid to line 132, such that the spring 131 moves the piloted valve 130 to the detent mode.

The third function in the detent mode is to vent the lock pin circuit 123, allowing the first lock pin 166 to engage the recess 170 of the housing assembly 100. The intermediate phase angle position or mid position is when the vane 104 is somewhere between the advance wall 102*a* and the retard wall 103*a* defining the chamber between the housing assembly 100 and the rotor assembly 105. The intermediate phase angle position can be anywhere between the advance wall 102*a* and retard wall 103*a* and is determined by where the detent passages 128 and 134 are relative to the vane 104.

Based on the duty cycle of the pulse width modulated variable force solenoid 107, the spool 161 moves to a corresponding position along its stroke. When the duty cycle of the variable force solenoid 107 is approximately 40%, 60%, or greater than 60%, the spool 161 will be moved to positions that correspond with the advance mode, the holding position, and the retard/retard locking mode, respectively and the piloted valve 130 will be pressurized and move to the second position, the hydraulic detent circuit 133 will be closed, and the first lock pin 166 will be pressurized and released. In the retard locking mode, the second lock pin 167 is pressurized to engage when the retard chamber 103 is in the full retard position and the retard locking port 179 is in fluid communication with the retard chamber 103, the advance chamber 102 vented and the second lock pin 167 engages the recess 163 of the outer end plate 171 of the housing assembly 100. It should be noted that in an alternate embodiment, the second lock pin 167 can be supplied with fluid by an advance locking port in fluid communication with the advance chamber when the phaser is in a full advance position, and the retard chamber 103 is vented, which then allows the second lock pin 167 to be pressurized to engage the recess and move to a locked position.

When the duty cycle of the variable force solenoid 107 is 0%, the spool 161 is moved to the detent mode such that the piloted valve 130 vents and moves to the second position, the hydraulic detent circuit 133 will be open, and the first lock pin 166 vented and engaged with the recess 170. A duty cycle of 0% was chosen as the extreme position along the spool stroke to open the hydraulic detent circuit 133, vent the piloted valve 130, and vent and engage the first lock pin 166 with the recess 170, since if power or control is lost, the phaser will default to a locked position. It should be noted that the duty cycle percentages listed above are an example and they may be altered. Furthermore, the hydraulic detent circuit 133 may be open, the piloted valve 130 vented, and the first lock pin 166 vented and engaged with the recess 170 at 100% duty cycle, if desired.

It should be noted that the duty cycle of the variable force solenoid 107 of approximately 40%, 60%, or greater than 60% may alternatively correspond to the spool 161 being moved to positions that correspond to the retard mode, the holding position, and the advance mode/advance locking mode, respectively.

When the duty cycle is set to be greater than 60%, the vane of the phaser is moving toward and/or in a retard position. The stroke of the spool or position of the spool relative to the sleeve is between 3.5 and 5 mm for the retard position.

Figure 5:
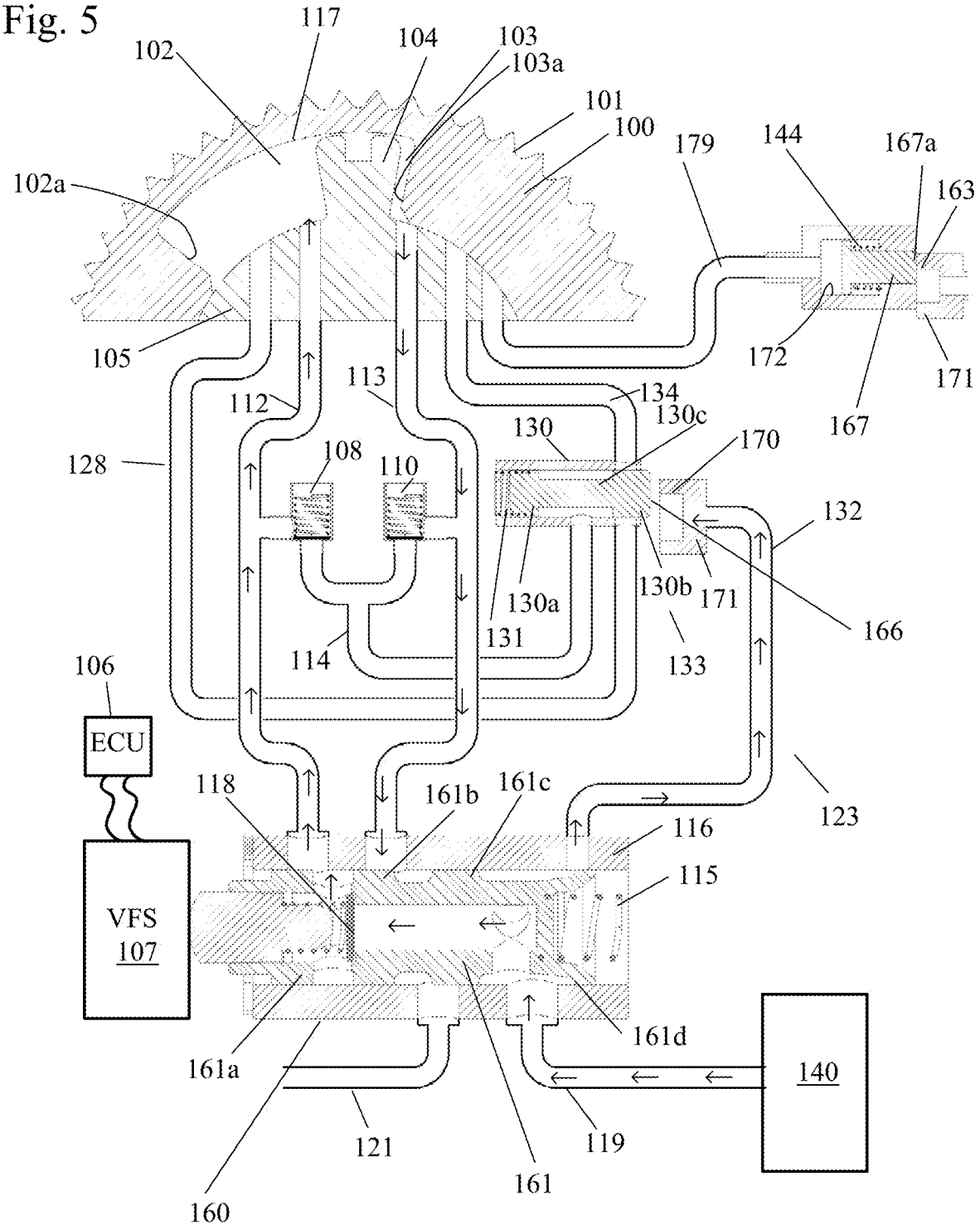
FIG. 5 shows a schematic of the torsion assist phaser moving towards the advance position.

FIG. 5 shows the phaser moving towards the advance position. To move towards the advance position, the duty cycle is 40% but not greater than 60%, the force of the VFS 107 on the spool 161 is decreased and the spool 161 is moved to the left by the spring 115 in an advance mode, until the force of the spring 115 balances the force of the VFS 107. In the advance mode shown, spool land 161*a* blocks the fluid of fluid from the advance chamber 102 to exhaust out the front of the spool valve 160, and spool land 161*b* prevents recirculation of fluid between the advance chamber 102 and the retard chamber 103. Line 112 is open to supply S from line 119 and line 113 is open to exhaust line 121 to exhaust any fluid from the retard chamber 103. Hydraulic fluid is supplied to the phaser from supply S by pump 140 and enters line 119. From line 119, fluid enters the control valve 160 and the inlet check valve 118. From the control valve 160, fluid enters line 112 and the advance chamber 102, moving the vane 104 towards the retard wall 103*a*, and causing fluid to exit from the retard chamber 103 and into line 113 to the control valve 160 and exhaust to sump through exhaust line 121. Due to the position of the retard lock port 179 relative to the retard chamber 103 (blocked), spring 144 biases the lock pin 167 to an unlocked position.

The pressure of the fluid in line 119 also moves through the spool 161 between lands 161*c* and 161*d* to line 132 to bias the first lock pin 166 against the spring 131 to a released position, filling the lock pin circuit 123 with fluid. The fluid in line 132 also pressurizes the piloted valve 130 against the spring 131, moving the piloted valve 130 to a position where retard detent line 134, advance detent line 128 and common line 114 are blocked and the detent circuit is off. The end of the spool 161 is blocked by spool land 161*d*, preventing the first lock pin 166 and piloted valve 130 from venting out the end of the spool 161.

Figure 3:
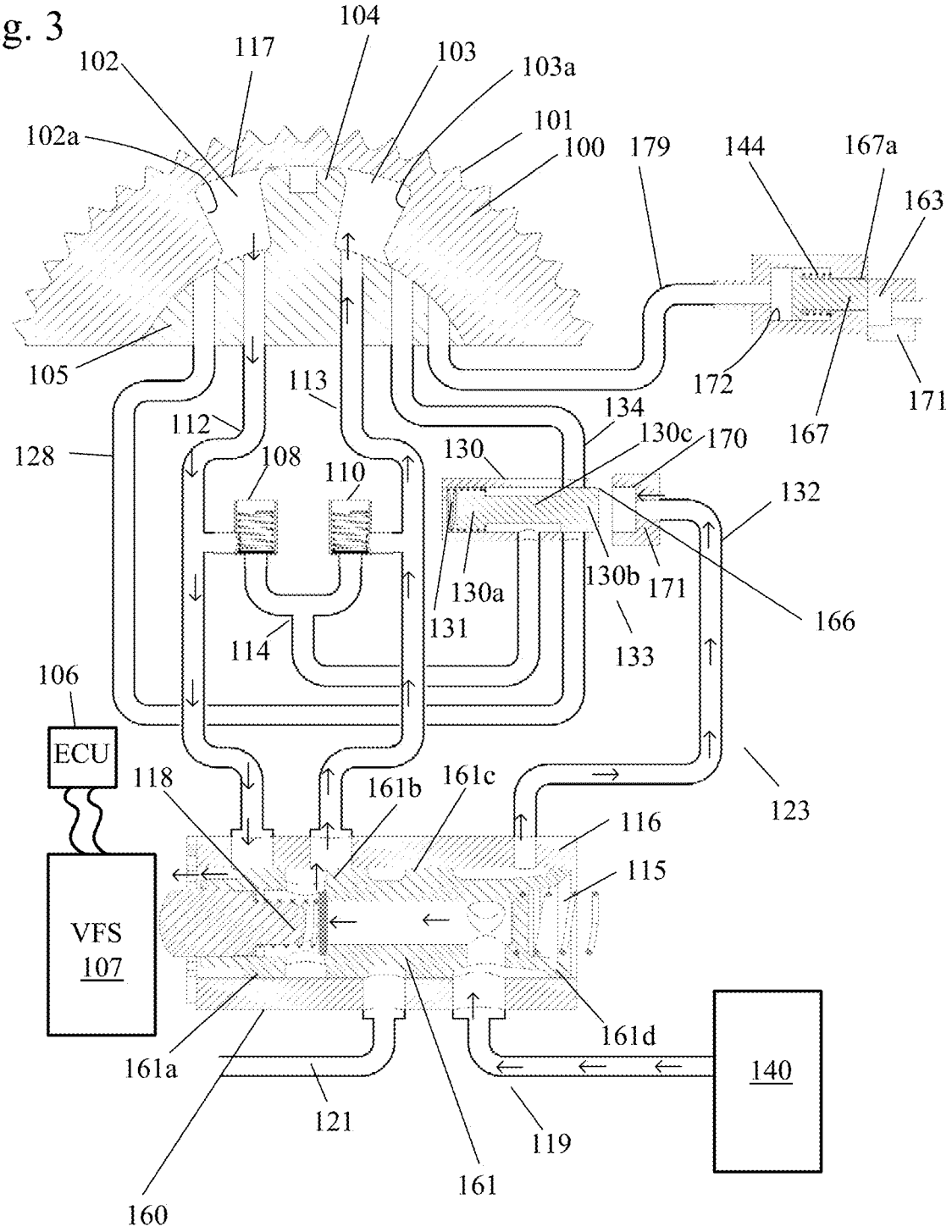
FIG. 3 shows a schematic of the torsion assist phaser in which lock pins are releasing and the phaser is moving towards the retard position.

FIG. 3 shows the phaser moving towards the retard position. To move towards the retard position, the duty cycle is adjusted to a range greater than 60%, the force of the VFS 107 on the spool 161 is changed and the spool 161 is moved to the right in a retard mode in the figure by VFS 107, until the force of spring 115 balances the force of the VFS 107. In the retard mode shown, spool land 161*b* blocks exhaust line 121 and spool land 161*a* prevents recirculation of fluid between the advance chamber 102 and the retard chamber 103. Line 113 is open to supply S from line 119 and line 112 is open to exhaust out the front of the spool valve 160 between spool land 161*a* and the sleeve 116 to exhaust any fluid from the advance chamber 102. Hydraulic fluid is supplied to the phaser from supply S by pump 140 and enters line 119. Line 119 is in fluid communication with the control valve 160. From the control valve 160, fluid passes through the inlet check valve 118 and enters line 113 and the retard chamber 103, moving the vane 104 towards the advance wall 102*a*, and causing fluid to move from the advance chamber 102 and exit into line 112 to the control valve 160 and exhaust to sump out the front of the spool valve 160 between the sleeve 116 and the first spool land 161*a*.

The pressure of the fluid in line 119 also moves through the spool 161 between lands 161*c* and 161*d* to line 132, to bias the first lock pin 166 against the spring 131 to a released position, filling the lock pin circuit 123 with fluid. The fluid in line 132 also pressurizes the piloted valve 130 against the spring 131, moving the piloted valve 130 to a position where retard detent line 134, advance detent line 128 and common line 114 are blocked and the detent circuit is off. The end of the spool 161 is blocked by spool land 161*d*, preventing the first lock pin 166 and piloted valve 130 from venting out the end of the spool 161.

Due to the position of the retard lock port 179, fluid is not provided to line 179 until the vane 104 is approximately adjacent to the advance wall 102*a*. Prior to the vane 104 being adjacent to the advance wall 102*a*, the spring 144 of the second lock pin 167 biases the lock pin to an unlocked position. Once the vane reaches the "full retard stop" discussed in further detail below and the retard lock port 179 becomes exposed to fluid present in the retard chamber 103, fluid from the retard lock port 179 biases the second lock pin 167 to attempt to engage the recess 163 of the outer end plate 171 when the recess 163 aligns with the second lock pin 167 as shown in FIG. 2, the housing assembly 100 is locked relative to the rotor assembly 105.

When the duty cycle is set greater than 60%, the vane of the phaser is moving toward and/or in a retard locking position. The stroke of the spool or position of the spool relative to the sleeve is approximately 3.5-5.0 mm for the retard locking position.

Figure 2:
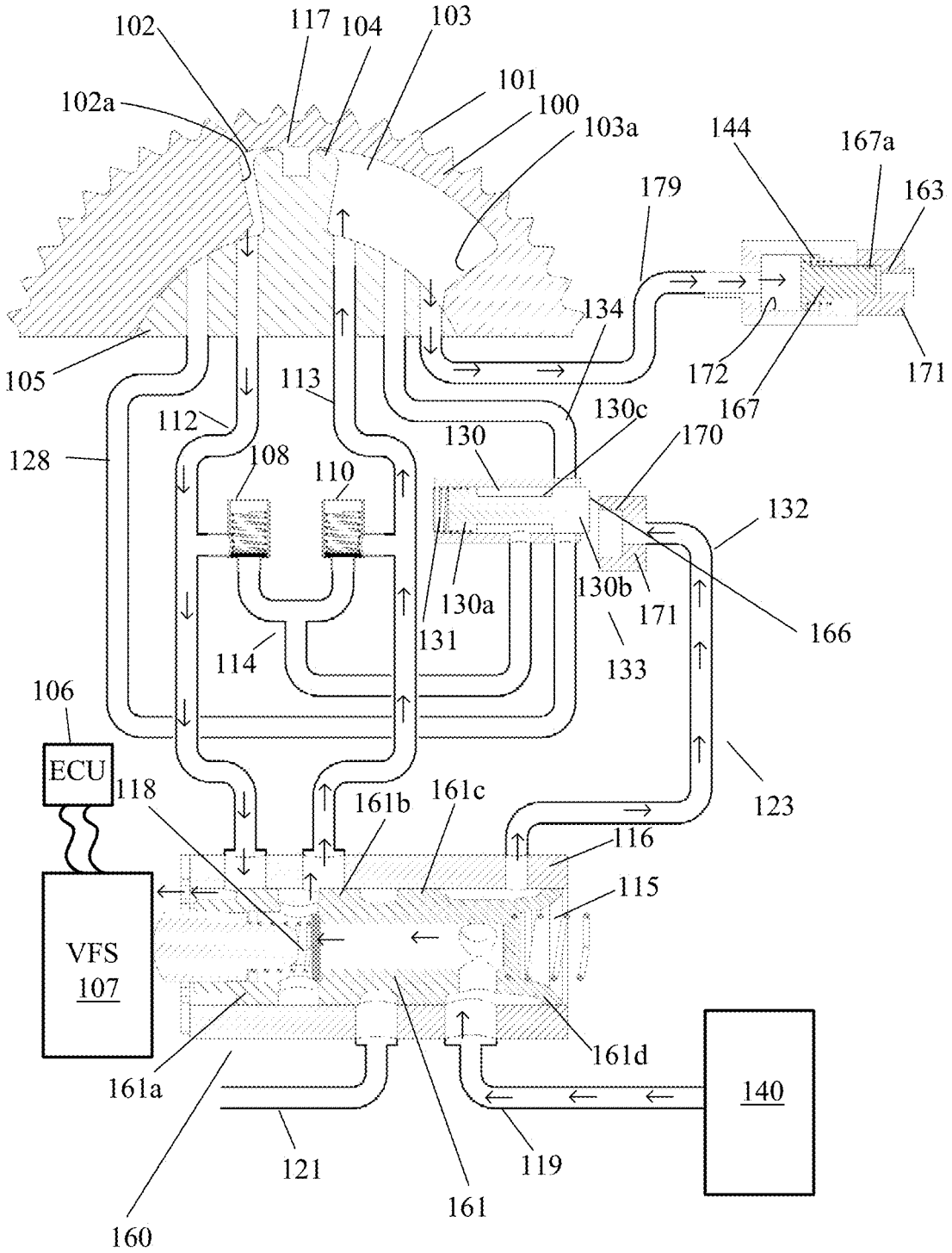
FIG. 2 shows a schematic of the torsion assist phaser in a full retard position with lock pin engagement.

FIG. 2 shows the phaser in the retard locking position at the full retard position. To move towards the retard position, the duty cycle is adjusted to a range greater than 60%, the force of the VFS 107 on the spool 161 is changed and the spool 161 is moved to the right in a retard mode in the figure by VFS 107, until the force of spring 115 balances the force of the VFS 107. In the retard locking mode shown, spool land 161*b* blocks exhaust line 121. Fluid is still allowed to exhaust from the advance chamber 102 to sump between sleeve 116 and spool land 161*a*, removing any recirculation between the advance chamber 102 and the retard chamber 103. Line 113 is open to supply S from line 119 and line 112 is open to exhaust through the front of the spool valve 160 adjacent spool land 161*a* to exhaust any fluid from the advance chamber 102. Hydraulic fluid is supplied to the phaser from supply S by pump 140 and enters line 119.

Line 119 leads to an inlet check valve 118 within the control valve 160. From the control valve 160, fluid passes through the inlet check valve 118 and enters line 113 and the retard chamber 103, moving the vane 104 towards the advance wall 102*a*, and causing fluid to move from the advance chamber 102 to exit into line 112 to the control valve 160 and exhaust to sump through the front of the spool valve 160. The phaser is in a full retard position when the vane 104 contacts or nearly contacts the advance wall 102*a*.

The pressure of the fluid in line 119 also moves through the spool 161 between lands 161*c* and 161*d* to line 132 to bias the first lock pin 166 against the spring 131 to a released position, filling the lock pin circuit 123 with fluid. The fluid in line 132 also pressurizes the piloted valve 130 against the spring 131, moving the piloted valve 130 to a position where retard detent line 134, advance detent line 128 and common line 114 are blocked and the detent circuit is off. The end of the spool is blocked by spool land 161*d*, preventing the first lock pin 166 and piloted valve 130 from venting out the back end of the spool 161.

Once the vane reaches the "full retard stop" the retard lock port 179 becomes exposed to fluid present in the retard chamber 103, and fluid from the retard lock port 179 biases the second lock pin 167 to engage the recess 163 of the outer end plate 171 when the recess 163 aligns with the second lock pin 167, locking the housing assembly 100 relative to the rotor assembly 105.

The holding position of the phaser preferably takes place between the retard and advance position of the vane relative to the housing. The stroke of the spool or position of the spool relative to the sleeve is approximately 3.5 mm.

FIG. 1 shows the phaser in the holding position. In this position, the duty cycle of the variable force solenoid 107 is approximately 60% and the force of the VFS 107 on one end of the spool 161 equals the force of the spring 115 on the opposite end of the spool 161 in holding mode. The lands 161*a* and 161*b* allow fluid from supply S to bleed into the advance chamber 102 and the retard chamber 103. Exhaust line 121 is blocked from exhausting fluid from line 113 by spool land 161*b* and exhausting of fluid out of the front of the spool valve 160 is prevented by spool land 161*a*. Line 119 provides fluid from pump 140, which enters the control valve 160, flows through the inlet check valve 118 and enters lines 112 and 113 and the advance chamber 102 and the retard chamber 103.

The pressure of the fluid in line 119 also moves through the spool 161 between lands 161*c* and 161*d* to line 132 to bias the first lock pin 166 against the spring 131 to a released position, filling the lock pin circuit 123 with fluid. The fluid in line 132 also pressurizes the piloted valve 130 against the spring 131, moving the piloted valve 130 to a position where retard detent line 134, advance detent line 128 and common line 114 are blocked and the detent circuit is off. The end of the spool 161 is blocked by spool land 161*d*, preventing the first lock pin 166 and piloted valve 130 from venting out the back end of the spool 161.

Due to the position of the retard lock port 179 relative to the retard chamber 103 (e.g. the retard locking port 179 is not accessible to the retard chamber 103), spring 144 of the second lock pin 167 biases the lock pin to an unlocked position.

When the duty cycle is 0%, the vane of the phaser is in the mid position or intermediate phase angle position. The stroke of the spool or position of the spool relative to the sleeve is 0 mm.

Figure 4:
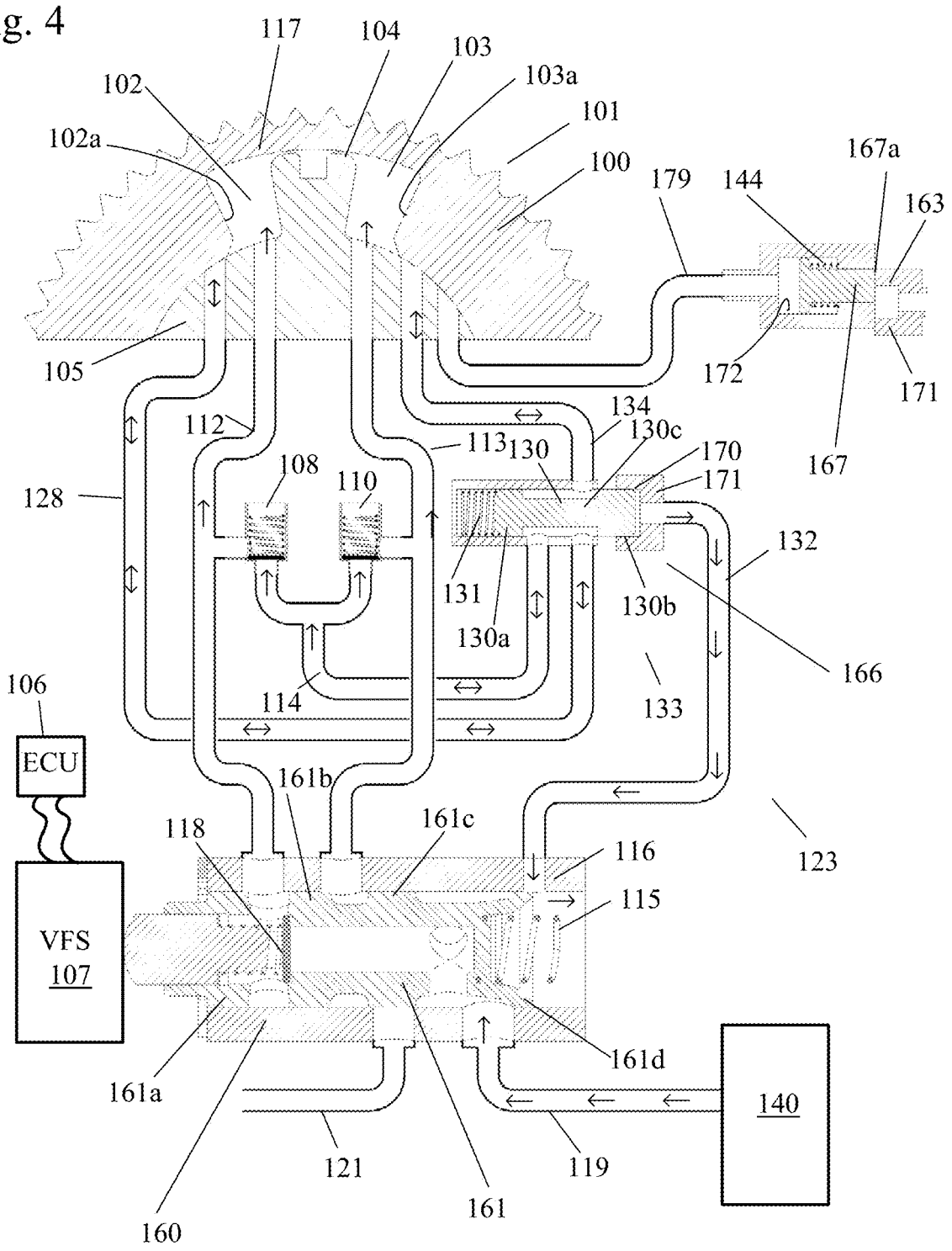
FIG. 4 shows a schematic of the torsion assist phaser in a midlock or intermediate locking position.

FIG. 4 shows the phaser in the mid position or intermediate phase angle position, where the duty cycle of the variable force solenoid is 0%, the spool 160 is in detent mode, the piloted valve 130 is vented through the end of the spool 161 near spool land 161*d*, leading to sump or exhaust, and the hydraulic detent circuit 133 is open or on and the first lock pin 166 is vented and engages with a recess 170, and the rotor assembly 105 is locked relative to the housing assembly 100 in a mid position or an intermediate phase angle position. Depending on where the vane 104 was prior to the duty cycle of the variable force solenoid 107 being changed to 0%, either the advance detent line 128 or the retard detent line 134 will be exposed to the advance or retard chamber 102, 103 respectively. In addition, if the engine had an abnormal shut down (e.g. the engine stalled), when the engine is cranking, the duty cycle of the variable force solenoid 107 would be 0%, the rotor assembly 105 would move via the detent circuit 133 to a mid lock position or an intermediate phase angle position and the first lock pin 166 would be engaged in mid position or intermediate phase angle position regardless of what position the vane 104 was in relative to the housing assembly 100 prior to the abnormal shut down of the engine. In the present invention, detent mode is preferably when the spool 161 is an extreme end of travel. In the examples shown in the present invention, it is when the spool 161 is at an extreme full out position from the bore.

The ability of the phaser of the present invention to detent to a mid position or intermediate phase angle position without using electronic controls allows the phaser to move to the mid position or intermediate phase angle position even during engine cranking when electronic controls are not typically used for controlling the cam phaser position. In addition, since the phaser detents to the mid position or intermediate phase angle position, it provides a fail-safe position, especially if control signals or power is lost, that guarantees that the engine will be able to start and run even without active control over the VCT phaser. Since the phaser has the mid position or intermediate phase angle position upon cranking of the engine, longer travel of the phase of the phaser is possible, providing calibration opportunities. In the prior art, longer travel phasers or a longer phase angle is not possible, since the mid position or intermediate phase angle position is not present upon engine cranking and startup and the engine has difficulty starting at either the extreme advance or retard stops.

When the duty cycle of the variable force solenoid 107 is set to 0%, the force on the VFS on the spool 161 is decreased, and the spring 115 moves the spool 161 to the far left end of the spool's travel to a detent position. In this detent position, spool land 161*c* blocks the flow of fluid from line 113 to exhaust port 121 and spool land 161*a* blocks the flow of fluid from line 112 to exhaust through the front of the spool valve 160, effectively removing control of the phaser from the control valve 160. At the same time, fluid from supply may flow through line 119 to the control valve 160 and inlet check valve 118 to line 112 and flow into the advance chamber 102 and the retard chamber 103 through lines 128 and 134 respectively. Fluid is prevented from flowing to line 132 by spool land 161*d*. Since fluid cannot flow to line 132, the first lock pin 166 is no longer pressurized and vents through the back end of the spool valve 160 and the piloted valve 130 is also vented, opening passage between the advance detent line 128 and the retard detent line 134 through the piloted valve 130 and the common line 114, in other words opening the hydraulic detent circuit 133 and essentially converting all of the torsion assist chambers into cam torque actuated chambers (CTA) or into CTA mode with circulation of fluid being allowed between the advance chamber 102 and the retard chamber 103.

Due to the position of the retard lock port 179 relative to the retard chamber 103 (e.g. the retard locking port is not accessible to the retard chamber 103), spring 144 of the second lock pin 167 biases the lock pin to an unlocked position.

If the vane 104 was positioned within the housing assembly 100 near or in the retard position and the retard detent line 134 is exposed to the retard chamber 103, then fluid from the retard chamber 103 will flow into the retard detent line 134 and through the open piloted valve 130 leading to common line 114. From the common line 114, fluid flows through check valve 108 and into the advance chamber 102, moving the vane 104 relative to the housing assembly 100 to close off the retard detent line 134 to the retard chamber 103. As the rotor assembly 105 closes off line the retard detent 134 from the retard chamber 103, the vane 104 is moved to an intermediate phase angle position or a mid position within the chamber formed between the housing assembly 100 and the rotor assembly 105, and the first lock pin 166 aligns with the recess 170, locking the rotor assembly 105 relative to the housing assembly 100 in a mid position or an intermediate phase angle position. It should be noted that the second lock pin 167 does not engage the recess 163 and remains in an unlocked position.

If the vane 104 was positioned within the housing assembly 100 near or in the advance position and the advance detent line 128 is exposed to the advance chamber 102, then fluid from the advance chamber 102 will flow into the advance detent line 128 and through the open piloted valve 130 and to common line 114. From the common line 114, fluid flows through check valve 110 and into the retard chamber 103, moving the vane 104 relative to the housing assembly 100 to close off or block advance detent line 128 to the advance chamber 102. As the rotor assembly 105 closes off the advance detent line 128 from the advance chamber 102, the vane 104 is moved to an intermediate phase angle position or a mid position within the chamber formed between the housing assembly 100 and the rotor assembly 105, and the first lock pin 166 aligns with recess 170, locking the rotor assembly 105 relative to the housing assembly 100 in a mid position or an intermediate phase angle position. It should be noted that the second lock pin 167 does not engage the recess 163 and remains in an unlocked position.

The advance detent line 128 and the retard detent line 134 are completely closed off or blocked by the rotor assembly 105 from the advance and retard chambers 102, 103 when phaser is in the mid position or intermediate phase angle position, requiring that the first lock pin 166 engages the recess 170 at the precise time in which the advance detent line 128 or the retard detent line 134 are closed off from their respective chambers. Alternatively, the advance detent line 128 and the retard detent line 134 may be slightly open or partially restricted to the advance and retard chambers 102, 103, in the mid position or intermediate phase angle position to allow the rotor assembly 105 to oscillate slightly, increasing the likelihood the first lock pin 166 will pass over the position of the recess 170 so the first lock pin 166 can engage the recess 170.

Alternatively, the retard locking mode may be replaced with an advance locking mode. In this mode, the detent valve circuit is off, and the second lock pin 167 is pressurized causing the second lock pin 167 to engage the recess 163 of the outer end plate 171 and move to a locked position. The "full advance position" is defined as the vane 104 contacting the retard wall 103*a* of the chamber 117. It should be noted that the layout would be a mirror image of that shown in FIGS. 1-5.

Figure 6:
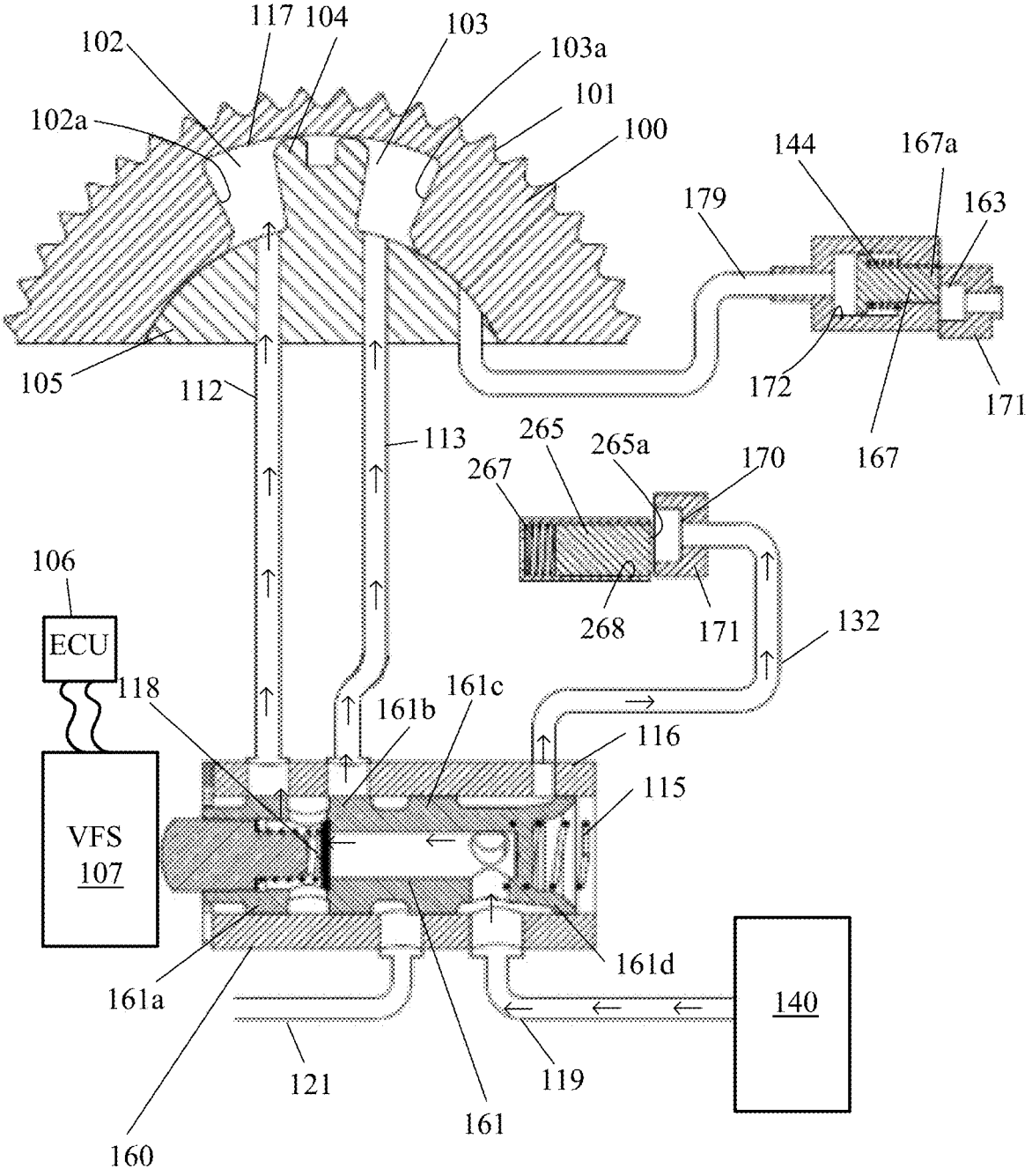
FIG. 6 shows a schematic of a torsion assist phaser with first and second locks pins which are pressurized to release at one stop and pressurized to engage at the opposite stop, with pressure being supplied to one lock pin from a working chamber and to one lock pin from supply.

FIG. 6 shows a phaser of an alternate embodiment. The alternate embodiment differs from the first embodiment of FIGS. 1-5 in that the piloted valve and detent mode are absent.

The housing assembly 100 of the phaser has an outer circumference 101 for accepting drive force. The rotor assembly 105 is connected to the camshaft and is coaxially located within the housing assembly 100. The rotor assembly 105 has a vane 104 separating a chamber 117 formed between the housing assembly 100 and the rotor assembly 105 into an advance chamber 102 and a retard chamber 103. The vane 104 is capable of rotation to shift the relative angular position of the housing assembly 100 and the rotor assembly 105.

A first lock pin 265 is in fluid communication with a control valve 160 and is actively controlled by position of the spool 161 of the control valve 160. The first lock pin 265 is slidably received within a bore 268 of the rotor assembly 105. The first lock pin 265 is spring 267 biased to a closed or locked position in which an end 265*a* of the lock pin 265 engages the recess 170 of the outer end plate 171 and locks the housing assembly relative to the rotor assembly 105. The first lock pin 265 also has an unlocked or open position in which fluid from supply via the control valve 160 and line 132 biases the end 265*a* out of engagement with the recess 170 of the outer end plate 171.

The second lock pin 167 is slidably housed in a bore 172 in the rotor assembly 105. An end portion 167*a* of the second lock pin 167 fits into a recess 163 in the outer end plate 171 of the housing assembly 100. The second lock pin 167 is pressurized by the retard chamber 103 to move towards the locked position through the retard lock port 179, engaging the recess 163. The retard lock port 179 is a predetermined distance or length from the vane 104 and is present in the rotor assembly 105. The retard lock port 179, while drawn schematically in the drawings, is positioned such that the port only receives fluid or is in fluid communication with the retard chamber 103 when the phaser is in the full retard position as discussed further below. The retard lock port 179 is not in fluid communication with the retard chamber 103 when the phaser is moving towards or in the advance position. The second lock pin 167 is spring 144 biased to move to the unlocked position, where the lock pin 167 does not engage the recess 163 of the housing assembly 100 and the retard lock port 179 is vented.

A control valve 160, preferably a spool valve, includes a spool 161 with cylindrical lands 161*a*, 161*b*, 161*c*, and 161*d* slidably received in a sleeve 116. The control valve 160 may be located remotely from the phaser, within a bore in the rotor assembly 105 which pilots in the camshaft, or in a center bolt of the phaser. One end of the spool 161 contacts spring 115 and the opposite end of the spool contacts a pulse width modulated variable force solenoid (VFS) 107. The solenoid 107 may also be linearly controlled by varying current or voltage or other methods as applicable. Additionally, the opposite end of the spool 161 may contact and be influenced by a motor, or other actuators. Hydraulic lines 112, 113 connect the control valve 160 to the advance chamber 102 and the retard chamber 103.

The position of the spool 161 is influenced by spring 115 and the solenoid 107 controlled by the EEC or ECU 106. Further detail regarding control of the phaser is discussed in detail below. The position of the spool 161 controls the motion (e.g. to move towards the advance position, holding position, the retard position, or the retard lock position) of the phaser as well as whether the first and second lock pins 167, 265 are locked or unlocked. In other words, the position of the spool 161 actively controls the position of the locks pins 167, 265. The control valve 160 has an advance mode, a retard mode, a retard locking mode, and a null mode (holding position).

In the advance mode, the spool 161 is moved to a position so that fluid may flow from supply S by pump 140, through line 119, through the inlet check valve 118 to the advance chamber 102 through line 112 and fluid from the retard chamber 103 exits from the chamber 103, through line 113 to the spool 161 and to exhaust line 121. The first lock pin 265 is moved to the unlock position by oil pressure from supply line 119 via line 132 and the second lock pin 167 is vented through the retard lock pin port 179 and spring 144 biased to an unlocked position in which neither lock pin 167, 265 engages a recess 163, 170 of the housing assembly 100.

In the retard mode, the spool 161 is moved to a position so that fluid may flow from supply S by pump 140 through line 119 and inlet check valve 118, to the retard chamber 103 through line 113 and fluid from the advance chamber 102 exits from the chamber 102 and flows through line 112 to the spool 161 to the engine between the first spool land 161*a* and the sleeve 116. The first lock pin 265 is biased by pressure from supply line 119 via line 132 to an unlocked position and the second lock pin 167 is biased by spring 144 to an unlocked position in which neither the first or second lock pins 265, 167 engage a recess 163, 170 of the housing assembly 100.

In holding position or null mode, the spool 161 is moved to a position that is partially open to the advance chamber 102 and the retard chamber 103 and allows supply fluid to bleed into the advance and retard chambers 102, 103 through lines 112, 113, applying the same pressure to the advance chamber and retard chamber to hold the vane 104 position. The first lock pin 265 is biased by supply pressure from supply line 119 via line 132 to an unlocked position and the second lock pin 167 is biased by spring 144 to an unlocked position in which neither the first or second lock pins 167, 265 engage a recess 163, 170 of the housing assembly 100.

In the retard locking mode, the vane 104 has already been moved to a full retard position and fluid continues to flow from supply S by pump 140 through inlet check valve 118 and through line 119, to the retard chamber 103 and fluid from the advance chamber 102 exits through the spool 161 to the engine block between the first spool land 161*a* and the sleeve 116. Fluid from the retard chamber 103 provides pressure to the second lock pin 167 through the retard locking port 179 to engage recess 163, as the retard locking port 179 in this position is in fluid communication with the retard chamber 103. The second lock pin 167 is pressurized to engage only when the vane 104 of the rotor assembly 105 is at or near the retard stop. The retard locking port 179 can be radial or axial and is metered by the housing assembly 100 or a feature in the end plate 171. Any duty cycle of the VFS 107 above the null position pressurizes the retard chamber 103. The "full retard position" is defined as the vane 104 contacting the advance wall 102*a* of the chamber 117. The first lock pin 265 is moved to the unlock position by oil pressure from supply line 119 via line 132 to an unlocked position.

Figure 7:
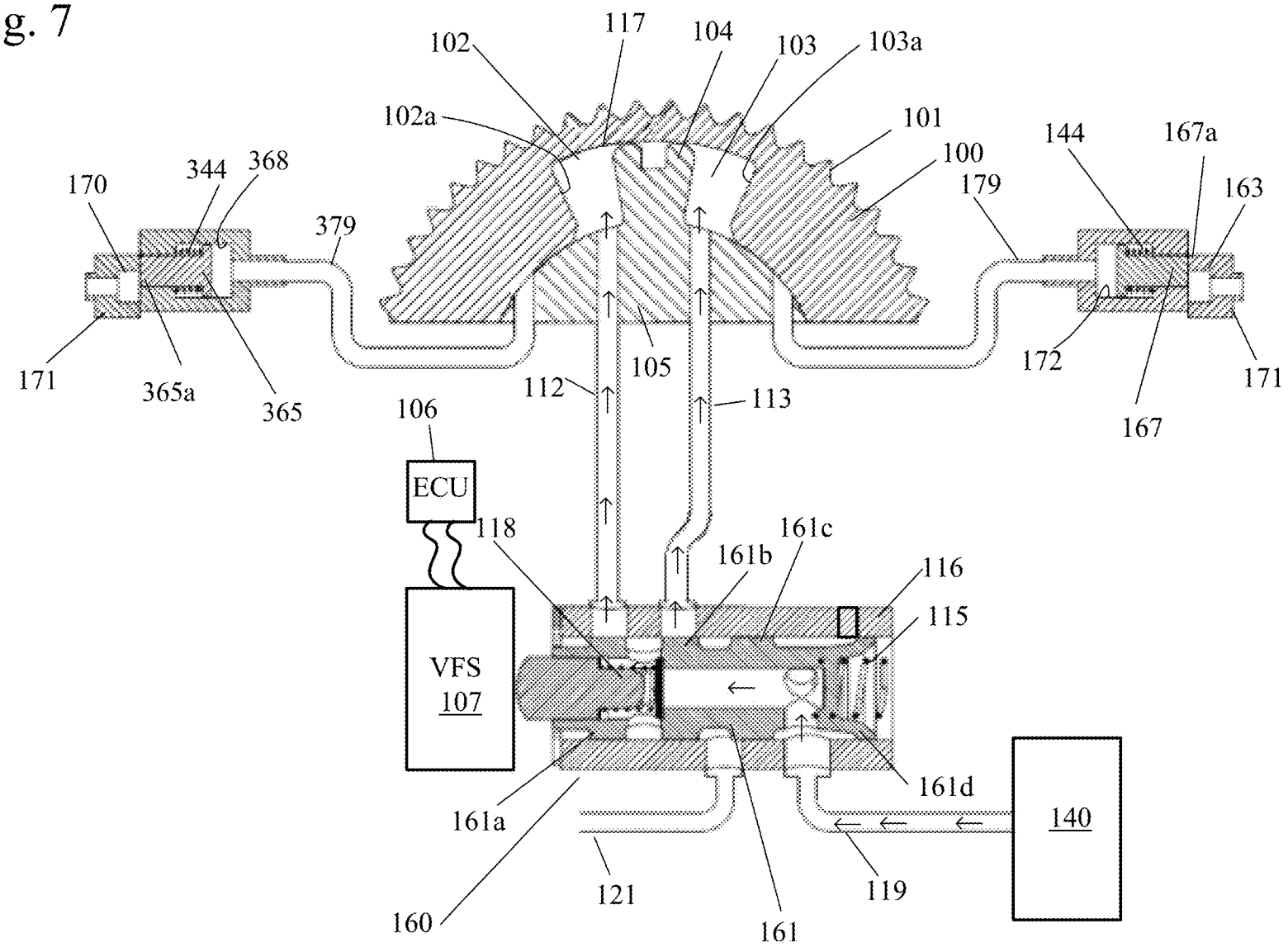
FIG. 7 shows a schematic of another torsion assist phaser with first and second locks pins which are pressurized to engage at opposite stops, with the pressure being supplied directly from working chambers of the phaser.

FIG. 7 shows a phaser of an alternate embodiment. This embodiment differs from the embodiment of FIG. 1-5 as the piloted valve 130 and the detent mode from the phaser are removed and the first lock pin is controlled by the advance chamber 102, not directly by the control valve 160.

The housing assembly 100 of the phaser has an outer circumference 101 for accepting drive force. The rotor assembly 105 is connected to the camshaft and is coaxially located within the housing assembly 100. The rotor assembly 105 has a vane 104 separating a chamber 117 formed between the housing assembly 100 and the rotor assembly 105 into an advance chamber 102 and a retard chamber 103. The vane 104 is capable of rotation to shift the relative angular position of the housing assembly 100 and the rotor assembly 105.

A first lock pin 365 is slidably housed in a bore 368 in the rotor assembly 105. An end portion 365*a* of the first lock pin 365 is biased towards and fits into a recess 170 in the outer end endplate 171 of the housing assembly 100. The first lock pin 365 is pressurized by the advance chamber 102 to move towards the locked position through the advance lock port 379, engaging the recess 170. The advance lock port 379 is a predetermined distance or length from the vane 104 and is present in the rotor assembly 105. The first lock pin 365 is biased to an unlocked position by spring 344. The advance lock port 379, while drawn schematically in the drawings, is positioned such that the port only receives fluid or is in fluid communication with the advance chamber 102 when the phaser is in the full advance position. The advance lock port 379 is not in fluid communication with the retard chamber 102 when the phaser is moving towards or in the advance position. The first lock pin 365 is spring 367 biased to move to the unlocked position, where the lock pin 365 does not engage the recess 170 of the housing assembly 100 and the advance lock port 379 is vented or not in fluid communication with the advance chamber 102.

The second lock pin 167 is slidably housed in a bore 172 in the rotor assembly 105. An end portion 167*a* of the second lock pin 167 is biased towards and fits into a recess 163 in the outer end plate 171 of the housing assembly 100. The second lock pin 167 is pressurized by the retard chamber 103 to move towards the locked position through the retard lock port 179, engaging the recess 163. The retard lock port 179 is a predetermined distance or length from the vane 104 and is present in the rotor assembly 105. The retard lock port 179, while drawn schematically in the drawings, is positioned such that the port only receives fluid or is in fluid communication with the retard chamber 103 when the phaser is in the full retard position as discussed further below. The retard lock port 179 is not in fluid communication with the retard chamber 103 when the phaser is moving towards or in the retard position. The second lock pin 167 is spring 144 biased to move to the unlocked position, where the lock pin 167 does not engage the recess 163 of the housing assembly 100 and the retard lock port 179 is vented.

A control valve 160, preferably a spool valve, includes a spool 161 with cylindrical lands 161*a*, 161*b*, 161*c*, and 161*d* slidably received in a sleeve 116. The control valve 160 may be located remotely from the phaser, within a bore in the rotor assembly 105 which pilots in the camshaft, or in a center bolt of the phaser. One end of the spool 161 contacts spring 115 and the opposite end of the spool 161 contacts a pulse width modulated variable force solenoid (VFS) 107. The solenoid 107 may also be linearly controlled by varying current or voltage or other methods as applicable. Additionally, the opposite end of the spool 161 may contact and be influenced by a motor, or other actuators. Hydraulic lines 112, 113 connect the control valve 160 to the advance chamber 102 and the retard chamber 103.

The position of the spool 161 is influenced by spring 115 and the solenoid 107 controlled by the EEC or ECU 106. Further detail regarding control of the phaser is discussed in detail below. The position of the spool 161 controls the motion (e.g. to move towards the advance position, holding position, the retard position, advance lock position or the retard lock position) of the phaser as well as whether the first and second lock pins 167, 365 are locked or unlocked. In other words, the position of the spool 161 actively controls the position of the locks pins 167, 365. The control valve 160 has an advance mode, a retard mode, a retard locking mode, advance lock mode and a null mode (holding position).

In the advance mode, the spool 161 is moved to a position so that fluid may flow from supply S by pump 140, through line 119, through the inlet check valve 118 to the advance chamber 102 through line 112 and fluid from the retard chamber 103 exits from the chamber 102, through line 113 to the spool 161 and to exhaust line 121. The first lock pin 365 is vented through the advance lock pin port 379 and the second lock pin 167 is vented through the retard lock pin port 179 such that each lock pin is spring biased 144, 344 to an unlocked position in which neither lock pin 167, 365 engages a recess 163, 170 of the housing assembly 100.

In the retard mode, the spool 161 is moved to a position so that fluid may flow from supply S by pump 140 through line 119 and inlet check valve 118, to the retard chamber 103 through line 113 and fluid from the advance chamber 102 exits from the chamber 103 and flows through line 112 to the spool 161 to the engine between the first spool land 161*a* and the sleeve 116. The first lock pin 365 is biased by spring 344 to an unlocked position and the second lock pin 167 is biased by spring 144 to an unlocked position in which neither the first or second lock pins 365, 167 engage a recess 163, 170 of the housing assembly 100.

In holding position or null mode, the spool 161 is moved to a position that is partially open to the advance chamber 102 and the retard chamber 103 and allows supply fluid to bleed into the advance and retard chambers 102, 103 through lines 112, 113, applying the same pressure to the advance chamber and retard chamber to hold the vane 104 position. The first lock pin 365 is biased by spring 344 to an unlocked position and the second lock pin 167 is biased by spring 144 to an unlocked position in which neither the first nor the second lock pins 167, 365 engage a recess 163, 170 of the housing assembly 100.

In the retard locking mode, the vane 104 has already been moved to a full retard position and fluid continues to flow from supply S by pump 140 through inlet check valve 118 and through line 119, to the retard chamber 103 and fluid from the advance chamber 102 exits through the spool 161 to the engine block between the first spool land 161*a* and the sleeve 116. Fluid from the retard chamber 103 provides pressure to the second lock pin 167 through the retard locking port 179 to engage recess 163, as the retard locking port 179 in this position is in fluid communication with the retard chamber 103. The second lock pin 167 is pressurized to engage only when the vane 104 of the rotor assembly 105 is at or near the retard stop. The retard locking port 179 can be radial or axial and is metered by the housing assembly 100 or a feature in the end plate 171. Any duty cycle of the VFS 107 above the null position pressurizes the retard chamber 103. The "full retard position" is defined as the vane 104 contacting or nearly contacting the advance wall 102*a* of the chamber 117. The first lock pin 365 is moved to the unlock position by spring 344 and venting of the advance lock port 379.

In the advance locking mode, the vane 104 has already been moved to a full advance position and fluid continues to flow from supply S by pump 140 through inlet check valve 118 and through line 119, to the advance chamber 102 and fluid from the retard chamber 103 exits through the spool 161 to the engine block between the second spool land 161*b* and the third spool land 161*c* to vent line 121. Fluid from the advance chamber 102 provides pressure to the first lock pin 365 through the advance locking port 379 to engage recess 170, as the advance locking port 379 in this position is in fluid communication with the advance chamber 102. The first lock pin 365 is pressurized to engage only when the vane 104 of the rotor assembly 105 is at or near the advance stop.

The advance locking port 379 can be radial or axial and is metered by the housing assembly 100 or a feature in the end plate 171. Any duty cycle of the VFS 107 below the null position pressurizes the advance chamber 102. The "full advance position" is defined as the vane 104 contacting or nearly contacting the retard wall 102*a* of the chamber 117. The second lock pin 167 is moved to the unlock position by spring 144 and venting of the retard lock port 167 to an unlocked position.

In yet another embodiment, an additional check valve may be added to the torsion assist phaser connected to or in fluid communication with the exhaust line 121 and the exhaustion of fluid out the front of the spool 161 between land 161*a* and the sleeve 116, adding a switchable recirculation function of the phaser. Switchable phaser are for example shown in US Publication No. 2017/0058727, which is hereby incorporated by reference.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A variable cam timing system including a phaser for an internal combustion engine including a housing assembly with an outer circumference for accepting a drive force and a rotor assembly coaxially located within the housing assembly for connection to a camshaft, having a plurality of vanes, wherein the housing assembly and the rotor assembly define at least one chamber separated by a vane into an advance chamber with an advance wall and a retard chamber with a retard wall, the vane within the chamber acting to shift relative angular position of the housing assembly and the rotor assembly when fluid is supplied to the advance chamber or the retard chamber, the system further comprising:

a control valve for directing fluid from a fluid input to and from the advance chamber and the retard chamber through an advance line, a retard line, a supply line coupled to the fluid input, and an exhaust line;

the control valve configured to move to an oil pressure actuated mode comprising: an advance mode in which fluid is routed from the fluid input to the advance chamber and fluid is routed from the retard chamber to the exhaust line, a retard mode in which fluid is routed from the fluid input to the retard chamber and fluid is routed from the advance chamber to a sump, a holding position in which fluid is routed to the advance chamber and the retard chamber and a retard locking mode in which the vane is adjacent to the advance wall;

a first lock pin slidably located in the rotor assembly, the first lock pin configured to move within the rotor assembly from a locked position in which an end portion of the first lock pin engages a first recess of the housing assembly, to an unlocked position in which the end portion does not engage the first recess of the housing assembly, the first recess in fluid communication with the supply line; and a second lock pin slidably located in the rotor assembly and in communication with the retard chamber through a lock port, the second lock pin configured to move within the rotor assembly from a locked position in which an end portion of the second lock pin engages a second recess of the housing assembly through pressure from the retard chamber via the lock port, to an unlocked position in which the end portion is spring biased to not engage the second recess of the housing assembly;

wherein when the control valve is in the retard locking mode, fluid from the retard chamber flows through the lock port to move the second lock pin to the locked position, locking the relative angular position of the housing assembly and the rotor assembly and the first lock pin is moved to the unlocked position by pressure supplied from the supply line.

2. The system of claim 1, wherein the control valve is further moveable to a detent mode and wherein when the control valve is in the detent mode, the control valve blocks the exhaust line, retaining fluid within the retard chamber, blocking the supply line to the first recess, such that the first lock pin engages the first recess of the housing assembly, locking the relative angular position of the housing assembly and the rotor assembly.

3. The system of claim 2, wherein when the control valve is moved to the detent mode, the second lock pin is moved to the unlocked position.

4. The system of claim 2, further comprising a detent circuit that is switchable from an open position to a closed position, wherein when the detent circuit is in the open position, the detent circuit moves the vane to an intermediate position within the at least one chamber defined by the housing assembly and the rotor assembly.

5. The system of claim 4, wherein when the detent circuit is in a closed position, the control valve is moved to the oil pressure actuated mode and fluid flows through the control valve to oil pressure actuate the advance and retard chambers.

6. The system of claim 5, wherein when the detent circuit is open, fluid is allowed to flow between an advance detent line to the advance chamber of the at least one chamber and a retard detent line to the retard chamber of the at least one chamber and a common line in fluid communication with the advance chamber and the retard chamber with advance and retard check valves, such that the rotor assembly is moved through cam torque actuation of the advance chamber of the at least one chamber and the retard chamber of the at least one chamber and held in an intermediate phase angle position relative to the housing assembly.

7. The system of claim 5, wherein the detent circuit is switchable between the open position and the closed position through a piloted valve.

8. The system of claim 7, wherein the piloted valve further comprises a spool have a first end and second end, wherein the first end is the first lock pin and fits in the first recess.

9. The system of claim 1, wherein when the control valve is moved towards the advance mode, the retard mode, or the holding position, the first lock pin is moved to the unlocked position.

10. The system of claim 1, wherein the control valve further comprises an inlet check valve.

11. The system of claim 1, wherein the first recess is in an inner end plate of the housing assembly and the second recess is in an outer end plate of the housing assembly.

12. The system of claim 1, wherein the control valve is located remotely from the phaser.

13. The system of claim 1, further comprising a first lock pin spring for biasing the first lock pin towards the first recess and a second lock pin spring for biasing the second lock pin away from the second recess in the housing assembly.

14. A variable cam timing system including a phaser for an internal combustion engine including a housing assembly with an outer circumference for accepting a drive force and a rotor assembly coaxially located within the housing assembly for connection to a camshaft, having a plurality of vanes, wherein the housing assembly and the rotor assembly define at least one chamber separated by a vane into an advance chamber with an advance wall and a retard chamber with a retard wall, the vane within the chamber acting to shift relative angular position of the housing assembly and the rotor assembly when fluid is supplied to the advance chamber or the retard chamber, the system further comprising:

a control valve for directing fluid from a fluid input to and from the advance chamber and the retard chamber through an advance line, a retard line, a supply line coupled to the fluid input, and an exhaust line;

the control valve configured to move to an oil pressure actuated mode comprising: an advance mode in which fluid is routed from the fluid input to the advance chamber and fluid is routed from the retard chamber to the exhaust line, a retard mode in which fluid is routed from the fluid input to the retard chamber and fluid is routed from the advance chamber to a sump, a holding position in which fluid is routed to the advance chamber and the retard chamber, a retard locking mode in which the vane is adjacent to the advance wall, and an advance locking mode in which the vane is adjacent the retard wall; and a first lock pin slidably located in the rotor assembly and in communication with the advance chamber through an advance lock port, the first lock pin configured to move within the rotor assembly from a locked position in which an end portion of the first lock pin engages a first recess of the housing assembly through pressure from the advance chamber via the advance lock port, to an unlocked position in which the end portion is spring biased by a first lock pin spring away from the first recess of the housing assembly;

a second lock pin slidably located in the rotor assembly and in communication with the retard chamber through a lock port, the second lock pin configured to move within the rotor assembly from a locked position in which an end portion of the second lock pin engages a second recess of the housing assembly through pressure from the retard chamber via the lock port, to an unlocked position in which the end portion is spring biased by a second lock pin spring away from the second recess of the housing assembly;

wherein when the control valve is in the retard locking mode, fluid from the retard chamber flows through the retard lock port to move the second lock pin to the locked position, locking the relative angular position of the housing assembly and the rotor assembly and the first lock pin is moved to the unlocked position by the first lock pin spring; and wherein when the control valve is in the advance locking mode, fluid from the advance chamber flows through the advance lock port to move the first lock pin to the locked position, locking the relative angular position of the housing assembly and the rotor assembly and the second lock pin is moved to the unlocked position by the second lock pin spring.

15. The system of claim 14, wherein the control valve further comprises an inlet check valve.

16. A variable cam timing system including a phaser for an internal combustion engine including a housing assembly with an outer circumference for accepting a drive force and a rotor assembly coaxially located within the housing assembly for connection to a camshaft, having a plurality of vanes, wherein the housing assembly and the rotor assembly define at least one chamber separated by a vane into an advance chamber with an advance wall and a retard chamber with a retard wall, the vane within the chamber acting to shift relative angular position of the housing assembly and the rotor assembly when fluid is supplied to the advance chamber or the retard chamber, the system further comprising:

a control valve for directing fluid from a fluid input to and from the advance chamber and the retard chamber through an advance line, a retard line, a supply line coupled to the fluid input, and an exhaust line;

the control valve configured to move to an oil pressure actuated mode comprising: an advance mode in which fluid is routed from the fluid input to the advance chamber and fluid is routed from the retard chamber to the exhaust line, a retard mode in which fluid is routed from the fluid input to the retard chamber and fluid is routed from the advance chamber to a sump, a holding position in which fluid is routed to the advance chamber and the retard chamber and an advance locking mode in which the vane is adjacent to the retard wall;

a first lock pin slidably located in the rotor assembly, the first lock pin configured to move within the rotor assembly from a locked position in which an end portion of the first lock pin engages a first recess of the housing assembly, to an unlocked position in which the end portion does not engage the first recess of the housing assembly, the first recess in fluid communication with the supply line; and a second lock pin slidably located in the rotor assembly and in communication with the retard chamber through a lock port, the second lock pin configured to move within the rotor assembly from a locked position in which an end portion of the second lock pin engages a second recess of the housing assembly through pressure from the advance chamber via the lock port, to an unlocked position in which the end portion is spring biased to not engage the second recess of the housing assembly; and wherein when the control valve is in the advance locking mode, fluid from the advance chamber flows through the lock port to move the second lock pin to the locked position, locking the relative angular position of the housing assembly and the rotor assembly and the first lock pin is moved to the unlocked position by pressure supplied from the supply line.

* * * * *